United States Patent [19]

Christensen

[11] 4,263,121

[45] Apr. 21, 1981

[54] METHOD TO FABRICATE POLYMERIC MEMBRANES AND DIAPHRAGMS

[75] Inventor: Marvin M. Christensen, Baton Rouge, La.

[73] Assignee: The Dow Chemical Company, Midland, Mich.

[21] Appl. No.: 83,442

[22] Filed: Oct. 10, 1979

[51] Int. Cl.[3] ..... C25B 13/08; C25B 9/00

[52] U.S. Cl. ..... 204/296; 204/266

[58] Field of Search ..... 204/296, 266

[56] References Cited

U.S. PATENT DOCUMENTS

| | | | |
|---|---|---|---|
| 2,936,261 | 5/1960 | Cole | 154/134 |
| 4,098,672 | 7/1978 | Riley | 204/296 |
| 4,165,248 | 8/1979 | Darlington et al. | 204/296 |

FOREIGN PATENT DOCUMENTS

| | | | |
|---|---|---|---|
| 1081046 | 8/1967 | United Kingdom | 204/296 |

*Primary Examiner*—R. L. Andrews
*Attorney, Agent, or Firm*—R. W. Selby

[57] ABSTRACT

A method is disclosed to fabricate shaped membranes or diaphragms with substantially leak-free seams suitable for use in electrolytic cells to produce a halogen and an alkali metal hydroxide. A preferred polymeric sheet material is formed into a desired configuration and a fusible substance is placed at or near the edges of the polymeric material prior to applying heat and, optionally, pressure to the fusible substance.

10 Claims, 2 Drawing Figures

METHOD TO FABRICATE POLYMERIC MEMBRANES AND DIAPHRAGMS

BACKGROUND OF THE INVENTION

This invention pertains to membranes and diaphragms suitable for the electrolytic production of a halogen and alkali metal hydroxide and more in particular to a method to fabricate such membranes and diaphragms by bonding polymeric materials together.

Gaseous halogens, such as chlorine, have been produced from alkali halides, for example sodium chloride, in electrolytic cells with an anode and cathode positioned within suitable compartments spaced apart by ion and liquid permeable asbestos diaphragms. More recently, attempts have been made to replace the asbestos diaphragm by either ion permeable and liquid impermeable polymeric ion exchange membranes or by ion and liquid permeable polymeric diaphragms. In any of such cells, a gaseous halogen is released at the anode and an aqueous solution of an alkali metal hydroxide is formed in the cathode compartment.

Oftentimes the polymeric membranes or diaphragms have unacceptably short life spans in the electrolytic cells because of leaks occurring at seams in the polymeric material permitting unacceptable quantities of electrolyte to flow from the anode compartment to the cathode compartment or vice versa. Such flow of electrolyte can reduce the efficiency of the electrolytic cell sufficiently to make it uneconomical to operate. It is, therefore, desired to provide a method to fabricate a polymeric membrane or diaphragm in such a manner to provide a membrane or diaphragm which is substantially leak-free at any seams, or joints, in the polymeric material.

SUMMARY OF THE INVENTION

The present invention relates to a method to fabricate a polymeric membrane or polymeric diaphragm suitable for use in an electrolytic cell for producing a halogen and an alkali metal hydroxide from an aqueous alkali metal halide solution. The hereinafter described method forms a shaped polymeric membrane, or diaphragm, with at least a portion of the edges bonded together in such a manner to result in a substantially fluid impermeable seal.

A fusible substance is placed on a surface portion of the polymeric material in close proximity to at least one of the edges of the polymeric material. The fusible substance is then contacted with a surface portion of the same, or a different, polymeric material so as to form a configuration suitable to be slideably fitted over an electrode for an electrolytic diaphragm cell. The fusible substance is then heated sufficiently to form a bond between the polymeric materials and the fusible material which is sufficiently leak-free to avoid a substantial loss in efficiency of the electrolytic cell in which the membrane or diaphragm is used.

The fusible substance may be of the same, or different, chemical composition as the polymeric material, but it is essential that it be chemically and/or physically more readily fused than the polymeric material.

BRIEF DESCRIPTION OF THE DRAWING

Identical numerals, within the several figures, represent parts having a similar function within the different embodiments.

DESCRIPTION OF THE PREFERRED EMBODIMENTS

Figure 1:
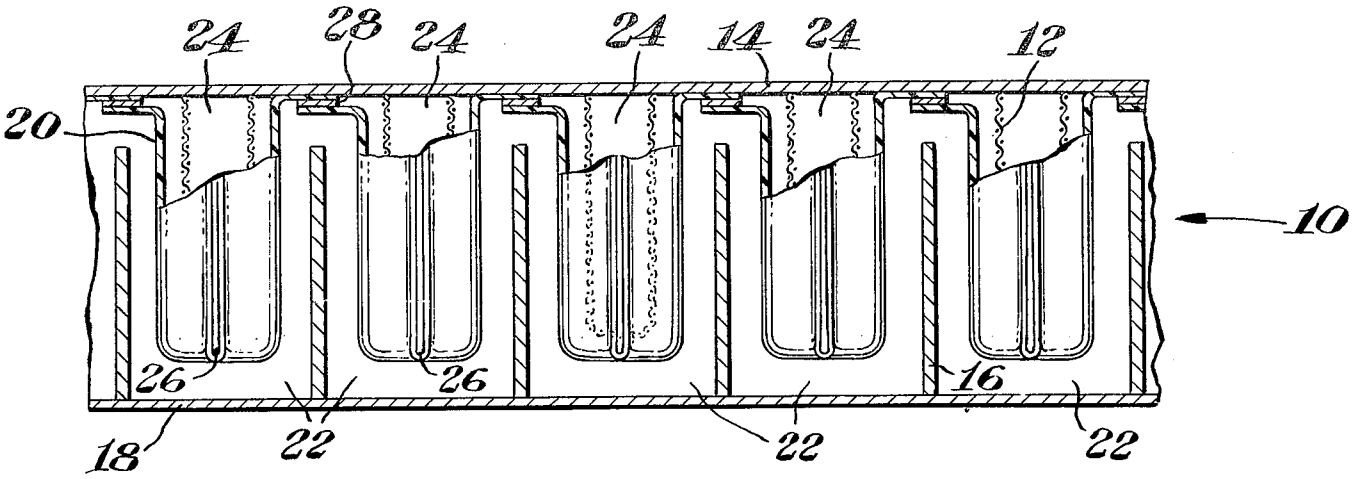
FIG. 1 is a cross-sectional plan view of a portion of an electrolytic cell showing finger-like cathodes and anodes with a polymeric membrane interleaved therebetween.

An electrolytic cell includes an anode compartment with an anode positioned therein juxtaposed and spaced apart from a cathode compartment with a cathode positioned therein. The anode compartment is spaced apart from the cathode compartment by an ion permeable, liquid impermeable polymeric membrane or an ion and liquid permeable diaphragm.

The polymeric material, such as a sheet, should be inert to the gases and liquids with which it comes into contact in the electrolytic cell. Desirably, the polymeric material is also flexible. Polymers and copolymers of various halogenated hydrocarbons can be employed for such membranes. For example, cation exchange membranes are well-known to contain fixed anionic groups that permit intrusion and exchange of cations, and exclude anions, from an external source. Generally, the resinous membrane has as a matrix a cross-linked polymer, to which are attached charged radicals such as $-SO_3^-$, $-COO^-$, $-PO_3^{--}$, $-HOP_2^-$, $-AsO_3^{--}$, and $-SeO_3^-$. Vinyl addition polymers and condensation polymers may be employed. The polymer can be, for example, styrene, divinylbenzene, polyethylene, and fluorocarbons. Condensation polymers are, for example, phenol, sulfuric acid, and formaldehyde resins. A method of preparing such resinous materials is described in U.S. Pat. No. 3,282,875.

The use of liquid permeable polymeric diaphragms is known, see, for example, U.S. Pat. Nos. 3,312,614 and 3,944,477. The method of the present invention is suitable for various polymeric diaphragms, for example, polyvinylidenefluoride and products with a fluorinated carbon backbone with a perfluoroalkoxy side chain (PFA), a fluorinated ethylene-propylene copolymer (FEP) and, preferably, polytetrafluoroethylene (TFE) which are commercially available under the trademark TEFLON ®.

The electrolytic cell further includes a source of an aqueous alkali metal chloride solution and means to introduce or feed such solution into the anode compartment. A gaseous halogen removal means, such as a pipe, is suitably connected to the anode compartment to afford removal of the gaseous halogen without substantial loss of such halogen to the ambient atmosphere. During operation of the electrolytic cell, the catholyte contains increasing concentrations of an alkali metal hydroxide, such as sodium hydroxide, which should be removed from the cathode compartment to reduce the hydroxide concentration. For this purpose, an alkali metal hydroxide removal means, such as a pipe, is in combination with the cathode compartment. If gaseous hydrogen is formed during electrolysis, a hydrogen removal means, such as a pipe, is suitably connected to the cathode compartment to permit removal of the gaseous hydrogen.

The cathode is preferably a member with at least the surface composed of a substantially inert material. For example, the cathode can be made of steel, titanium, tantalum, tungsten, and the like.

The anode is constructed of a material such as graphite or what is known in the art as a dimensionally stable metal anode. Such metal anode can be, for example, a valve metal as titanium or tantalum coated or plated with materials including, for example, at least one metal or oxide of the platinum group metals including Ru, Rh, Pd, Ag, Os, Ir, Pt, and Au.

A source of electrical energy is electrically connected to an energy transmission or carrying means such as an aluminum or copper conduit to transmit direct electrical current to the anode and the cathode.

The polymeric membrane or diaphragm formed by the method of the present invention satisfactorily serves to space apart oppositely charged electrodes in the electrolytic cell to produce a gaseous halogen, such as chlorine, from an aqueous solution or brine of, for example, sodium chloride. The particular membrane or diaphragm employed replaces the asbestos-type diaphragms common to the well-known chlorine-caustic electrolytic cells. For example, a porous polytetrafluoroethylene mat or sheet can be sealably formed into a pocket-like structure and positioned around what is known in the art as a "pocket cathode". An example of such a cell is shown in U.S. Pat. No. 2,858,263.

In FIG. 1 is generally depicted a portion of an electrolytic cell 10 with porous metal cathodes 12 protruding from the surface of a cell backboard 14. Graphite or metal anodes 16 are interposed between the cathodes and extend from a second backboard 18. A polymeric membrane or, preferably, a polymeric diaphragm 20, is interleaved in a wave-like manner between the cathodes 12 and the anodes 16. The diaphragm 20 may be fitted around either the cathode 12 or the anode 16, but is usually and conveniently attached to the cathode and/or the cathode back plate 14.

In the hereinafter description of the diaphragm 20, reference will be made to the preferred polytetrafluoroethylene material; however, it is not to be construed that reference to polytetrafluoroethylene, in any way, limits the scope of the present invention. To form the pocket-like configuration of the diaphragm 20, a sheet or film of liquid permeable polytetrafluoroethylene can be folded in such a manner to provide one closed edge and three open edges where the polytetrafluoroethylene sheet is not joined. To provide a pocket to fit around the cathode 12 without leakage of substantial quantities of electrolyte between the anode compartment 22 and the cathode compartment 24, it is necessary for two of the three open edges of the polytetrafluoroethylene sheet to be sealed in a substantially leak-tight manner.

Sealing or bonding of polytetrafluoroethylene adequately to permit economic use of this material as a diaphragm in an electrolytic cell has proven to be difficult. It has been determined that positioning a fusible substance 26 between open edge portions of the diaphragm 20 and thereafter heating at least the fusible substance to a temperature sufficient to bond the fusible substance 26 to the open edges to the diaphragm 20 results in a pocket-like polytetrafluoroethylene diaphragm useful in an electrolytic cell for producing chlorine and sodium hydroxide from an aqueous brine-containing sodium chloride.

In a like manner, individual pockets of the diaphragm 20 can be joined into a continuous, wave-like diaphragm with substantially leak-free joints by inserting a fusible material 28 between edge portions of separate diaphragm pockets and thereafter heating the fusible substance 28 to a temperature adequate to bond the polytetrafluoroethylene portions together. Generally, and conveniently, the fusible substance has a lower melting or fusing temperature than does the polymeric material used for the diaphragm. For example, suitable substances with melting temperatures lower than that of polytetrafluoroethylene are PFA and FEP.

The fusible substance may be in the physical form of a film or sheet which can be simply placed in between edge surface portions of the polytetrafluoroethylene diaphragm prior to heating and applying a sufficient pressure to the joint to obtain a coherent, substantially liquid impervious seal during heating to the fusing temperature of the fusible substance. Alternatively, and preferably, a fusible liquid containing, for example, particulate, PFA and/or FEP can be applied to one or both surfaces of the polytetrafluoroethylene diaphragm to be bonded together prior to application of the heat necessary for fusing and any pressure applied simultaneously with such heating. Before heating to the fusing temperature, any liquid applied to the polytetrafluoroethylene sheet is removed by, for example, air drying or heating to a temperature lower than that necessary for fusing.

It has been found that with PFE and FEP temperatures of from about 490° to about 600° F. and application of a pressure of from about 5 to about 200 pounds per square inch gauge to the joint, while heating to the fusing temperature, are adequate to form a diaphragm which will withstand the severe conditions of an electrolytic cell for producing chlorine and caustic from a brine.

The following example further illustrates the instant invention wherein surface portions of an essentially nonfusible, fluorine-containing polymer are joined together by use of a fusible fluorine-containing polymer interposed between sheets of the essentially nonfusible, fluorine-containing polymer at or near juxtaposed edges of the polymer sheets. The methods of joining such sheets with the fusible polymer interposed therebetween are illustrative and other techniques conventional in plastics fabrication can be employed to join the fusible and nonfusible polymers to form a preferred liquid, leak-free joint resistant to the corrosive effects of the environment within the electrolytic cell.

EXAMPLE 1

Porous TFE sheet material available from Fluorotechniques of Bellport, N.Y., under a product designation of M7R1000, was made into what might be considered a generally cup-like, paraboloid or closed cylindroid configuration. This was carried out by cutting a generally rectangular piece of the TFE sheet into a predetermined size and shape of approximately one side of a cathode. Two pieces of TFE cut to such shape were then joined together at the edges to form a cup-like pocket using a Vertrod Corporation high temperature thermal sealer. Prior to use of such thermal sealing equipment, a commercial, aqueous dispersion containing FEP (TEFLON® fluorocarbon resin dispersion type 120) was applied, by painting, to the peripheral surface portions of the shaped TFE sheets which were to be sealed. The liquid portion of the dispersion was air dried prior to placing the shaped TFE sheets together with the painted portions in mutual contact. Using the Vertrod Corporation's sealing equipment, an air pressure of 25 psig was applied to the sealer jaws (about 140 psi on the TFE sheet) substantially simultaneously with application of sufficient heat to raise the temperature of the material to be sealed to about 520° F. for a sufficient time to permit a coherent, substantially liquid, leak-free bond to be obtained between the previously separate pieces of TFE sheet. Usually, it is only necessary to apply the heat for from about 2 to about 60 seconds.

In a similar manner, a number of TFE diaphragm pockets were connected together at a location shown in FIG. 1 as 28.

Figure 2:
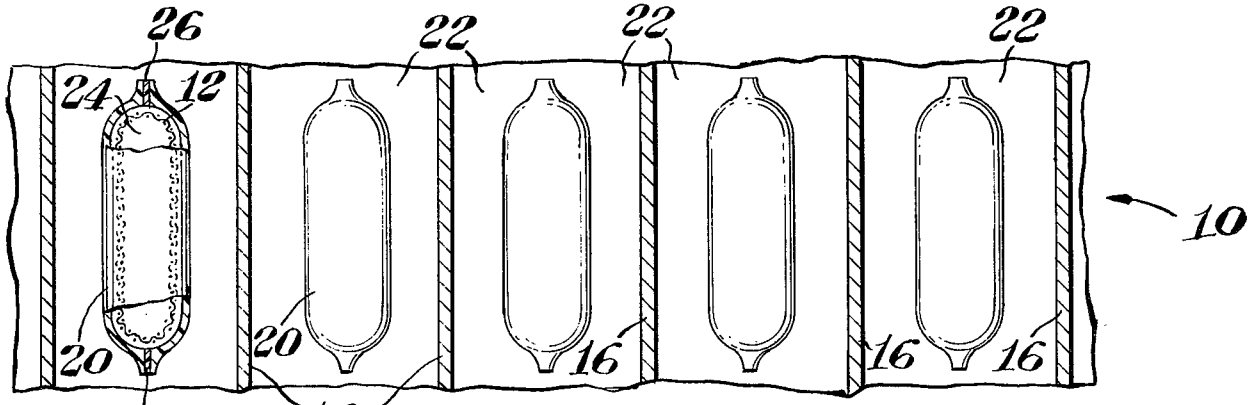
FIG. 2 is representative of an elevation view of the electrolytic cell as shown in FIG. 1.

The connected series of TFE diaphragm pockets were surroundingly positioned outside a series of porous ferrous cathodes in a manner similar to that shown in FIGS. 1 and 2. The electrolytic cell, with graphite anodes, was operated satisfactorily to produce chlorine and an aqueous sodium hydroxide solution from a sodium chloride brine for an extended period of time with substantially no leakage of electrolyte occurring through the sealed joints of the TFE. Failure of a portion of the diaphragm at a seal suddenly occurred after more than a month's operation. It is believed that this failure occurred because the diaphragm did not properly fit around the cathode and this resulted in sufficient stress to pull part the diaphragm.

EXAMPLE 2

In a similar manner, a rectangular piece of porous TFE is folded in half along the length to form a shape suitable to fit around the exterior of a cathode. A strip of a fusible polymeric material with a lower melting temperature than TFE, such as PFA, is inserted between those edges of the TFE which are to be sealed. Sufficient heat and pressure are then applied as in Example 1, to fuse the polymeric strip to the TFE and provide an adherent, leak-tight seal between the TFE surfaces of the diaphragm pocket. The pocket is then readily attached to a cathode and/or a cathode backplate around a cathode in an electrolytic cell.

What is claimed is:

1. A method to fabricate a polymeric membrane or polymeric diaphragm for an electrolytic cell to produce a halogen and an alkali metal hydroxide from an aqueous alkali metal halide solution comprising:

(a) placing a fusible substance on at least one surface portion of the polymeric material at or near at least one edge of the polymeric material, the fusible substance being more readily fusible than the polymeric material;

(b) contacting the fusible substance with the same or a different polymeric material so as to form a configuration suitable to encase the working portion of an electrode for an electrolytic diaphragm cell;

(c) heating the fusible substance sufficiently to form a substantially leak-free bond between the polymeric material and the fusible material.

2. The method of claim 1 wherein the heating is carried out at a temperature lower than the fusing temperature of the polymeric material.

3. The method of claim 2 wherein the heating is carried out at a temperature of about 490° to about 600° F.

4. The method of claim 1 wherein the polymeric material is polytetrafluoroethylene.

5. The method of claim 1 wherein the heating is carried out at a temperature of about 490° to about 600° F.

6. The method of claims 1, 5 or 3 including applying a pressure of from about 5 to about 200 pounds per square inch gauge to that portion of the membrane to be bonded during heating.

7. An electrolytic cell for producing a halogen and an alkali metal hydroxide from an aqueous alkali metal halide solution comprising an anode and a cathode disposed in suitable compartments spaced apart by a polymeric membrane or polymeric diaphragm with one open end and at least a portion of the closed end having edge portions thermally bonded together by at least one fusible substance interposed between separate portions of the polymer material, the fusible substance being more readily fusible than the polymeric material, means to feed the solution to the cell, means to remove the gaseous halogen from the anode compartment, means to remove the alkali metal hydroxide from the cathode compartment and means to conduct an electric current to the anode and cathode.

8. The electrolytic cell of claim 7 wherein the bonded polymeric material is a pocket-like structure encasing the working portion of the cathode.

9. The electrolytic cell of claim 7 wherein the bonded polymeric material is a pocket-like structure with the bonded edges positioned at the upper and lower portions of the pocket-like structure.

10. The electrolytic cell of claims 7 or 9 wherein the polymeric material is polytetrafluoroethylene.

* * * * *

UNITED STATES PATENT AND TRADEMARK OFFICE

CERTIFICATE OF CORRECTION

PATENT NO. : 4,263,121

DATED : April 21, 1981

INVENTOR(S) : Marvin M. Christensen

It is certified that error appears in the above-identified patent and that said Letters Patent are hereby corrected as shown below:

Col. 2, line 29, $-HOP_2-$ should read $-HPO_2-$.

Col. 5, line 23, delete "part" and insert --apart--.

Signed and Sealed this

*Twenty-second* Day of *September 1981*

[SEAL]

*Attest:*

GERALD J. MOSSINGHOFF

*Attesting Officer*

*Commissioner of Patents and Trademarks*